United States Patent [19]

Wang

[11] Patent Number: 4,745,243

[45] Date of Patent: May 17, 1988

[54] DECORATIVE LIGHT SWITCH COVER

[76] Inventor: Paul S. Wang, 16033 Villa Flores Dr., Hacienda Heights, Calif. 91745

[21] Appl. No.: 941,681

[22] Filed: Dec. 15, 1986

[51] Int. Cl.[4] ..... H01H 3/20; H01H 17/00

[52] U.S. Cl. ..... 200/331; 200/330; 446/323

[58] Field of Search ..... 200/330, 331, 329, 332, 200/333, 335, 336; 174/55, 66; 446/323, 489, 361, 364

[56] References Cited

U.S. PATENT DOCUMENTS

| | | | |
|---|---|---|---|
| 2,461,614 | 2/1949 | Seaman | 200/331 |
| 2,466,820 | 4/1949 | Oberschmidt | 200/331 |
| 2,574,933 | 11/1951 | Ogren | 200/330 |
| 2,712,582 | 7/1955 | Peretti | 200/330 |
| 2,919,334 | 12/1959 | Jones | 200/331 |
| 4,221,946 | 9/1980 | Halstrum | 200/331 |
| 4,282,591 | 8/1981 | Andreuccetti | 174/66 |
| 4,562,325 | 12/1985 | De Rouen | 200/331 |

FOREIGN PATENT DOCUMENTS

| | | | |
|---|---|---|---|
| 101912 | 11/1916 | United Kingdom | 446/361 |

*Primary Examiner*—Henry J. Recla
*Assistant Examiner*—Linda J. Sholl
*Attorney, Agent, or Firm*—Keith D. Beecher

[57] ABSTRACT

A decorative light switch cover for a child's room which may be easily mounted over an existing wall switch, and which serves to turn the wall switch on and off when respective actuator cords are pulled by the child. The cover also includes a decorative design with one or more moving elements that are shifted from one position to another as the wall switch is actuated. The light switch cover may be easily mounted in place over the light switch merely by removing the standard light cover by unscrewing the mounting screws, and by replacing the standard cover with the decorative cover of the invention.

3 Claims, 1 Drawing Sheet

DECORATIVE LIGHT SWITCH COVER

BACKGROUND OF THE INVENTION

Wall switch actuator members adapting existing standard light switches to enable them to be actuated by children pulling on one or more pull cords are known to the art. However, the prior art devices for the most part involve certain disadvantages which make them unsuitable for mass production, and to be easily installable on existing light switches.

The prior art devices may be divided essentially two classes. The first class involves pivoting switch mechanisms which are best installed within the switch itself. Typical of these devices is U.S. Pat. No. 2,461,614, Seaman, which shows an external pivot arm actuated by two pull cords which, in turn, actuates a switch. Variations of the Seaman mechanism may be seen in U.S. Pat. No. 4,221,946—Halstrum, and U.S. Pat. No. 2,466,820—Oberschmidt. In each instance an arm is coupled to a side pivot point and is actuated between a first and a second angle. A small aperture within the arm engages the normal actuating handle of the switch.

The second class involves sliding mechanisms which, in essence, replace the existing switch plate upon a wall switch. Such units include U.S. Pat. No. 2,760,035—Friesen, which discloses an elaborate casing enclosing a moving actuating mechanism which is positioned by two pull cords. Similar vertical sliding mechanisms are disclosed in U.S. Pat. No. 3,839,615—Bradford which is directed to an encased sliding vertical actuating mechanism. U.S. Pat. No. 2,582,379—Goldberg discloses another form of a covering side plate, and U.S. Pat. No. 3,825,710—Roberts shows yet another version of a vertical side plate in which a figure performs an animated motion.

The decorative light switch cover of the present invention takes on the characteristics of the two prior art classes discussed above, in that it involves a pivoted arm which operates the switch as appropriate actuating cords are pulled, and the unit of the invention is constructed to replace the existing switch plate upon a wall switch.

The prior art mechanisms have, in practice, significant disadvantages which it is desirable to overcome, especially for a child's use. The prior art pivoting switch mechanisms involve relatively delicate structures which can best be mounted within the switch mechanism itself, and they are in general too complicated to permit easy installation in the home by unskilled personnel. Moreover, the prior art devices usually are too flimsy in practice to resist the normal wear and tear imposed upon them by a child.

The prior art sliding mechanisms, while appearing more rugged, have a disadvantage in that they are susceptible to breakage because of a lack of compliance should the mechanism be twisted in any direction, other than a vertical slide. Accordingly, this type of prior art switch has a tendency to be easily broken.

An objective of the present invention is to provide a decorative light switch cover which is easily installed, merely by replacing the standard switch cover; and which is rugged in its construction and simple to operate. The switch cover of the invention has an additional property in that it allows for ready decoration with movable elements to provide a unit attractive to small children.

Accordingly, the present invention provides a simple, useful, easily decorated adapter for an electric wall switch which permits operation by small children and which may be readily installed in the home by an unskilled person, without requiring that the existing light switch be disassembled. Moreover, the unit of the invention is rugged in its construction, and is capable of trouble-free operation over relatively long periods of time.

DETAILED DESCRIPTION OF THE ILLUSTRATED EMBODIMENT

Figure 2:
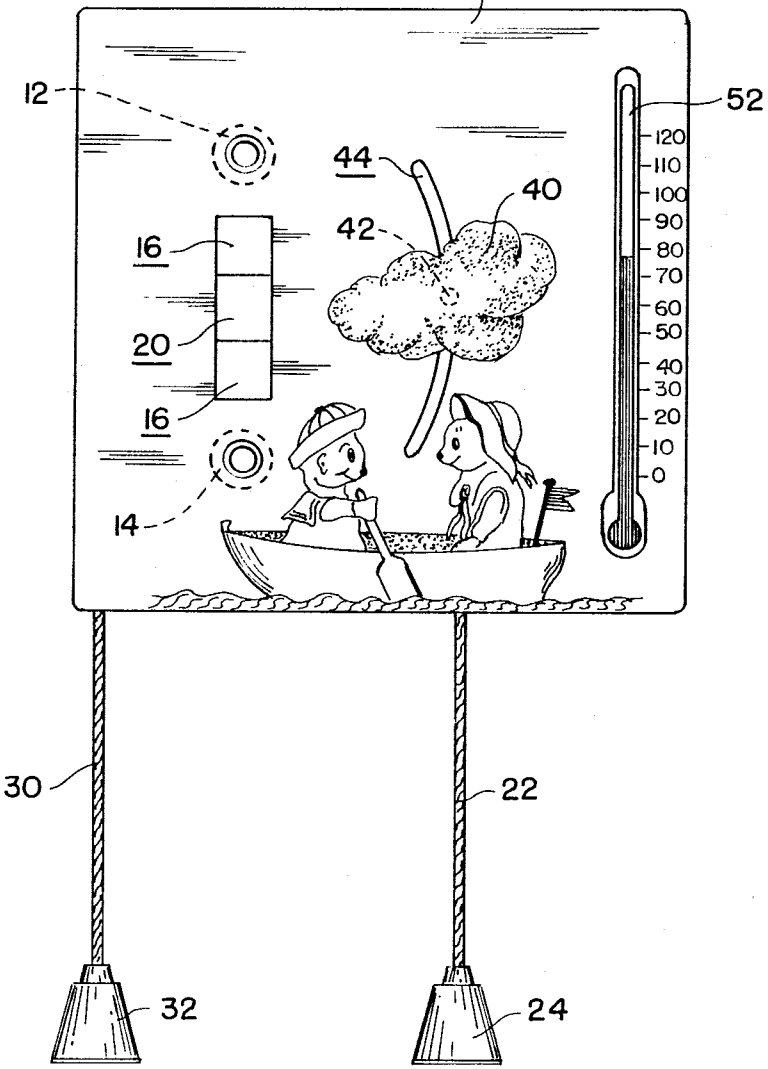
FIG. 2 is a front view of the assembly of FIG. 1.
Figure 1:
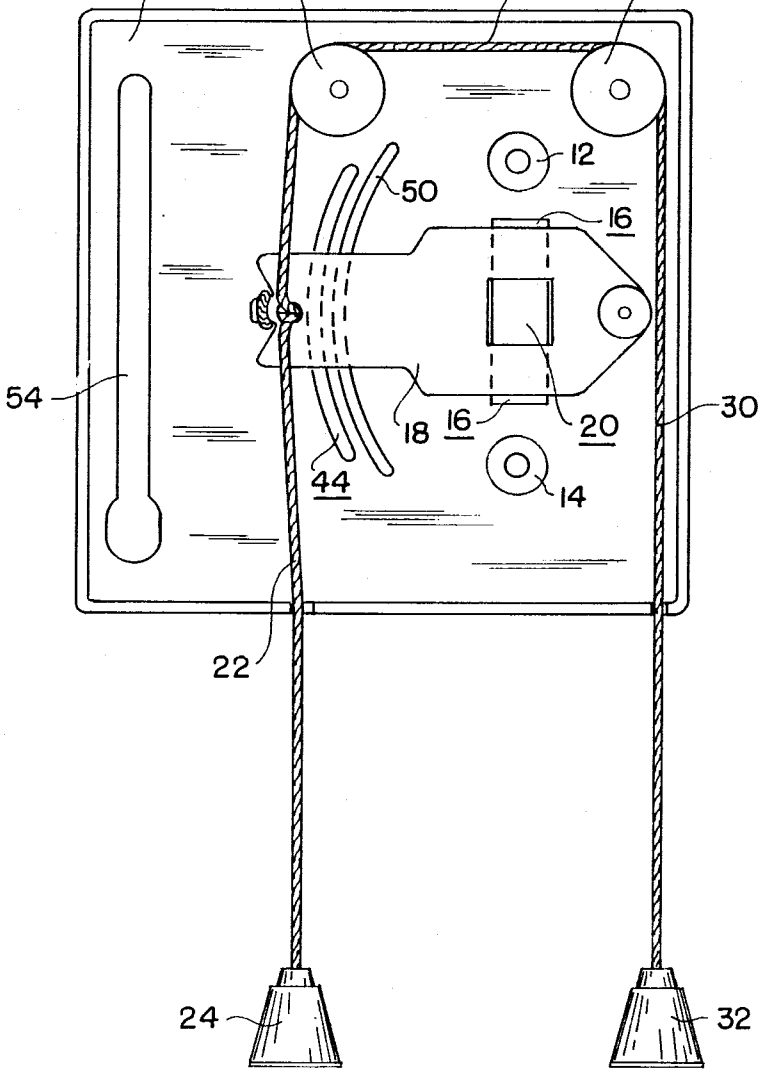
FIG. 1 is a rear view of a decorative light switch cover assembly constructed in accordance with one embodiment of the invention.

The decorative actuator assembly as shown in FIGS. 1 and 2, includes a decorative cover plate 10. Cover plate 10 has bushings 12 and 14 formed integral with the rear side thereof for receiving mounting screws, so that the decorative plate may be mounted over an existing wall switch in place of the standard cover plate.

The decorative cover plate has an opening 16 which is in position to receive the actuating arm of the wall switch. A lever arm 18 is pivotally mounted on the rear side of the decorative cover, and the lever arm has an opening 20 adjacent to the opening 16 in the decorative cover plate. The opening 20 in the lever arm 18 also receives the actuating arm of the wall switch, and when the lever arm is moved between first and second angular positions, the wall switch is turned on and off.

The assembly includes a first cord 22 which is secured at one end to the forward extremity of lever arm 18. The cord 22 extends down through a slot in the decorative cover plate 10. A knob 24 is attached to the other end of the cord 22.

A pair of pulleys 26 and 28 are mounted on the rear side of the decorative cover plate 10, and a second cord 30 having one end attached to the extremity of the lever arm 18 passes around the pulleys 26 and 28 and out through a slot in the bottom edge of the decorative cover plate 10. A second knob 32 is attached to the other end of the cord 30.

When cord 22 is pulled, the lever arm is moved down to a first angular position to turn the wall switch off, for example. On the other hand, when the cord 30 is pulled, the lever arm is moved up to a second angular position to turn the wall switch on.

Any appropriate design may be imprinted on the front side of the decorative cover plate 10. The design may include a movable design element 40 which may, for example, be in the form of a cloud. The design element 40 has a pin 42 which extends perpendicular to the plane of the design element 40 and through a slot 44 to the rear side of the decorative cover plate 10. The other end of pin 42 is attached to lever arm 18. Accordingly, when the lever arm 18 is moved by cords 20 and 30, the design element 40 moves up and down, with its pin 42 moving from one end of slot 44 to the other. The slot 44 in conjunction with pin 42 limits the angular movement of the lever arm 18 so that its first and second angular positions at which the switch is turned on and off are set.

An arcuate ramp 50 is formed integral with the rear side of decorative cover plate 14 to form a bearing surface for the lever arm 18.

A thermometer 52 may be mounted in a well 54 in the cover plate 10, as shown.

The invention provides, therefore, a simple switch actuator assembly which may easily be mounted over a wall switch merely by removing the standard cover plate and replacing it with the decorative cover plate of the invention. The actuator assembly of the invention is rugged in its construction, and is capable of withstanding rough usage by children. Moreover, the operation of the assembly is simple, and the child is entirely shielded from the electrical elements of the wall switch.

It will be appreciated that while a particular embodiment of the invention has been shown and described, modifications may be made. It is intended in the claims to cover all modifications which come within the true spirit and scope of the invention.

I claim:

1. A decorative switch actuator assembly for a wall switch to replace the standard cover plate of the switch, the wall switch including an actuating arm, and the actuator assembly comprising: a decorative cover plate adapted to be mounted over the wall switch, said decorative cover plate having an opening therein for receiving the actuating arm of the wall switch; a lever arm pivotally mounted on the rear side of said decorative cover plate having an opening therein for receiving the actuating arm of the wall switch and for moving said actuating arm from one operating position to another to turn the wall switch on and off when said lever arm is angularly turned about its pivot point between first and second angular positions; a first cord secured at one end of said lever arm to move said lever arm to said first angular position as said first cord is pulled; a pair of pulleys mounted on the rear side of said decorative cover plate and said first cord extending around said pulleys; a second cord secured at said one end of said lever arm to move said lever arm to said second angular position when said second cord is pulled; said first and second cords extending through the lower edge of said decorative cover plate; a moveable design element positioned on the front side of said decorative cover plate and coupled to said lever arm to cause said design element to move from one position to another as said lever arm is operated by said cords; and a pin-like member attached to said movable design element and extending at right angles to the plane of movement of said design element through a slot in said decorative cover plate and attached to said lever arm for coupling said design element to said lever arm.

2. The decorative actuator assembly defined in claim 1, in which said decorative cover plate has bushings therein for receiving mounting screws to enable the cover plate to be mounted over the wall switch.

3. The decorative actuator assembly defined in claim 1, in which said movable design simulates a cloud.

* * * * *